US005669254A

United States Patent [19]

Lee

[11] Patent Number: 5,669,254

[45] Date of Patent: Sep. 23, 1997

[54] LOCKING DEVICE

[75] Inventor: Chi-Hou Lee, Taipei, Taiwan

[73] Assignee: Simple Locksmith Co., Ltd., Taiwan

[21] Appl. No.: 628,860

[22] Filed: Apr. 5, 1996

[51] Int. Cl.[6] ..... E05B 67/22

[52] U.S. Cl. ..... 70/38 A; 70/39; 70/387; 70/377; 70/386

[58] Field of Search ..... 70/38 A, 38 C, 70/38 R, 39, 52, 287, 286, 392, 377

[56] References Cited

U.S. PATENT DOCUMENTS

| | | | |
|---|---|---|---|
| 158,111 | 12/1874 | Miller | 70/387 |
| 964,331 | 7/1910 | Stone | 70/38 C |
| 1,451,860 | 4/1923 | Best | 70/386 |
| 3,834,197 | 9/1974 | Sedley | 70/387 |
| 4,587,815 | 5/1986 | Gil | 70/392 |
| 4,838,058 | 6/1989 | Matsumoto | 70/387 |
| 5,146,770 | 9/1992 | Yun-Sheng | 70/387 |
| 5,331,330 | 7/1994 | Su | 70/39 |
| 5,417,092 | 5/1995 | Iu | 70/386 |

*Primary Examiner*—Darnell M. Boucher

*Attorney, Agent, or Firm*—Beveridge, DeGrandi, Weilacher & Young, L.L.P.

[57] ABSTRACT

A locking device which includes a casing, a U-shackle, two locking plates mounted in the casing to lock the U-shackle in the casing, a lock cylinder driven by a card to release the locking plates from the U-shackle, wherein the lock cylinder includes a mounting shell mounted in the casing, a tumbler holder mounted within the mounting shell to hold a set of tumblers, a set of springs, and a set of steel balls, the steel balls being displaced to release the tumblers from the mounting shell for permitting the tumbler holder to be lifted to unlock the locking plates when the card is inserted through a card slot on the casing into a bottom slot on the mounting shell and a bottom slot on the tumbler holder.

1 Claim, 4 Drawing Sheets

LOCKING DEVICE

BACKGROUND OF THE INVENTION

The present invention relates to locking devices, and relates more particularly to such a padlock designed to be unlocked by a card.

A variety of padlocks have been disclosed, and have appeared on the market. These padlocks are commonly designed to be unlocked by a particular key. However, it is not convenient to carry a lot of keys for unlocking conventional mechanical locks. There is known a padlock designed to be unlocked by a particular card. This structure of padlock is comprised of a casing having a locking mechanism, a cover covered on the casing after the installation of the locking mechanism, and a U-shackle having two opposite ends respectively inserted into respective shackle slots on the casing and locked by the locking mechanism. This structure of pad lock is complicated to assemble. Furthermore, the cover can be easily disconnected from the casing by a pry or the like. Therefore, this structure of padlock is not safe in use.

SUMMARY OF THE INVENTION

The present invention has been accomplished to provide a locking device which eliminates the aforesaid drawbacks. It is one object of the present invention to provide a locking device which is designed to be unlocked by a card. It is another object of the present invention to provide a locking device which is easy to assemble and inexpensive to manufacture. It is still another object of the present invention to provide a locking device which has an integral casing which holds the mechanical parts on the inside and effectively protects the mechanical parts against a pry or the like. According to the preferred embodiment of the present invention, the locking device comprises includes a casing, a U-shackle, two locking plates mounted in the casing to lock the U-shackle in the casing, and a lock cylinder driven by a card to release the locking plates from the U-shackle. The lock cylinder comprises a mounting shell mounted in the casing, a tumbler holder mounted within the mounting shell to hold a set of tumblers, a set of springs, and a set of steel balls, wherein the steel balls are displaced to release the tumblers from the mounting shell for permitting the tumbler holder to be lifted to unlock the locking plates when the card is inserted through a card slot on the casing into a bottom slot on the mounting shell and a bottom slot on the tumbler holder.

DETAILED DESCRIPTION OF THE PREFERRED EMBODIMENT

Figure 1:
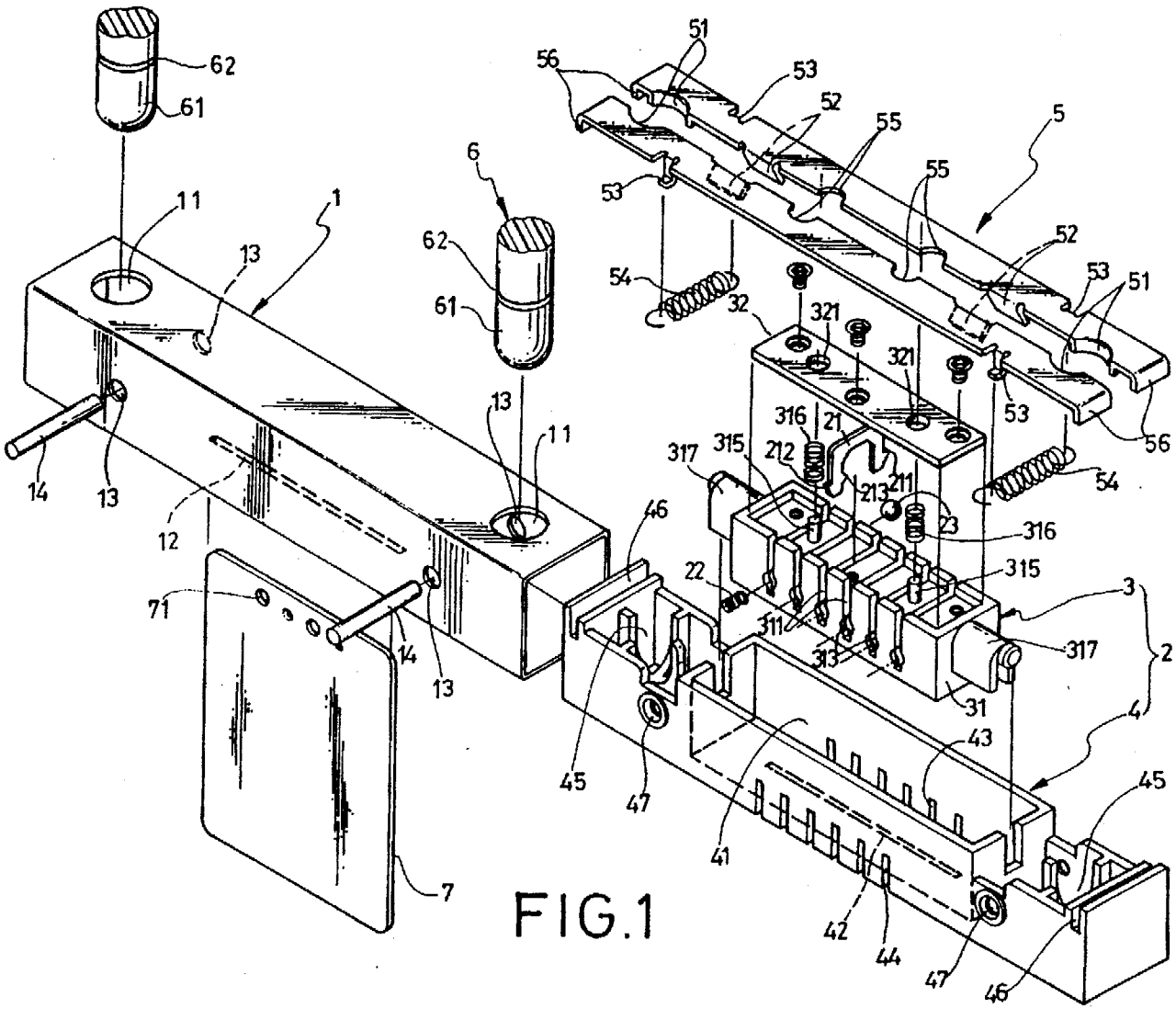
FIG. 1 is an exploded view of a locking device according to the present invention.
Figure 2:
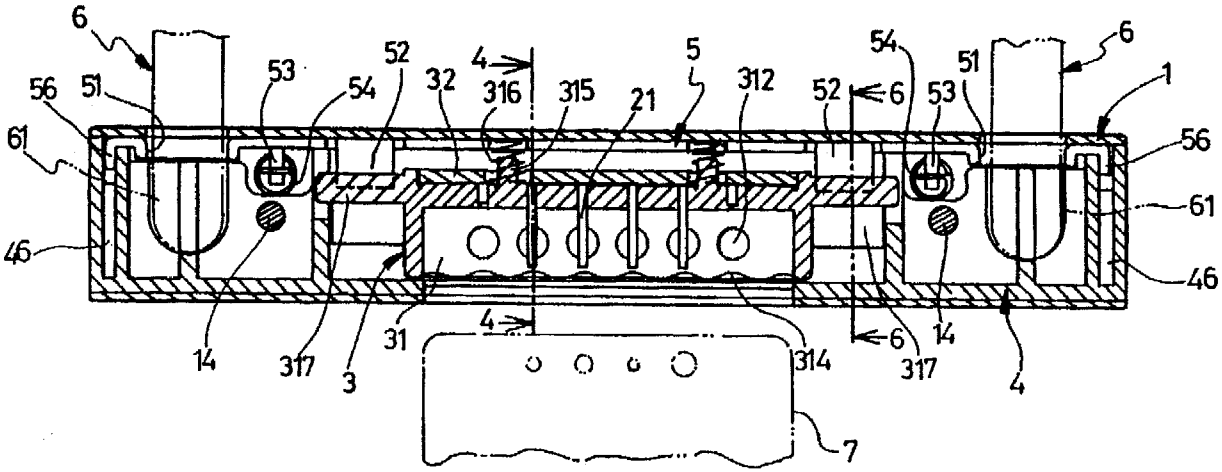
FIG. 2 is a sectional assembly view of the locking device shown in FIG. 1 when locked.

Referring to FIGS. from 1 to 7, a locking device in accordance with the present invention is generally comprised of a casing 1, a lock cylinder 2, two locking plates 5, and a shackle 6. The casing 1 is mechanically processed from metal, having a rectangular shape, two shackle holes 11 at the top side near two opposite ends, a card slot 12 at the bottom side, two pairs of pin holes 13 respectively aligned at the front and back sides. The lock cylinder 2 is mounted within the casing 1, comprising a tumbler holder 3, a mounting shell 4, a plurality of tumblers 21, a plurality of springs 22, and a plurality of steel balls 23.

The tumbler holder 3 comprises a rectangular base 31 having a plurality of U-shaped tumbler slots 311 longitudinally spaced at the top, a plurality of first transverse holes 312 and a plurality of second transverse holes 313 at two opposite sides and respectively extending from the tumbler slots 311 at the bottom in reversed directions. Through the first transverse holes 312, the steel balls 23 can be respectively inserted into the inside of the rectangular base 21, and the first hooked portions 211 of the tumblers 21 can be moved in and out of the rectangular base 31. Through the second transverse holes 313, the springs 22 can be respectively inserted into the inside of the rectangular base 21, and the second hooked portions 212 can be moved in and out of the rectangular base 31. The rectangular base 31 further comprises a bottom slot 314 corresponding to the card slot 12 of the casing 1 and in communication with the first transverse holes 312 for the insertion of the card, referenced by 7, to move the steel balls 23 sideways, two upright posts 315 raised from the top, two springs 316 respectively mounted around the upright posts 315, and two press blocks 317 longitudinally aligned at two opposite ends. A cover board 32 is covered on the rectangular base 31 at the top and supported on the springs 316 to hold down the tumblers 21 in the U-shaped tumbler slots 311, having two through holes 321 for the passing of the upright posts 315.

Each of the tumblers 21 has a substantially U-shaped profile, a first hooked portion 211 and a second hooked portion 212 raised from two opposite ends at an outer side in reversed directions, and a third hooked portion 213 raised from one end at an inner side. When the tumblers 21 are respectively inserted into the U-shaped tumbler slots 311, the two opposite ends of the tumblers 21 are respectively disposed in contact with the steel balls 23 in the first transverse holes 312 and the springs 22 in the second transverse holes 313 to prohibit the steel balls 23 and the springs 22 from escaping out of the rectangular base 31, and the third hooked portions 213 are respectively forced into engagement with the springs 22.

The mounting shell 4 has a rectangular shape, a longitudinal chamber 41, which receives the tumbler holder 3, a bottom slot 42 corresponding to the card slot 12 of the casing 1 for the insertion of the card 7, a plurality of first vertical slots 43 and a plurality of second vertical slots 44 at two opposite sides of the longitudinal chamber 41 corresponding to the first transverse holes 312 and second transverse holes 313 of the rectangular base 31, two transverse grooves 46 at two opposite ends, two retaining holes 45 spaced between the transverse grooves 46 and the longitudinal chamber 41, and two pairs of pin holes 47 at two opposite sides corresponding to the pin holes 13 of the casing 1. The retaining holes 45 are adapted to receive the ends 61 of the shackle 6. When the lock is locked, the second hooked portions 212 of the tumblers 21 respectively hook on the second vertical slots 44 of the mounting shell 4.

The locking plates 5 are symmetrical and longitudinally dispose in parallel over the top side of the mounting shell 4, each locking plate 5 comprising two downward end flanges 56 at two opposite ends respectively inserted into the transverse grooves 46 of the mounting shell 4, two first circularly arched notches 51 longitudinally spaced at an inner side between the downward end flanges 56 and adapted to engage the ends 61 of the shackle 6 respectively, two downward contact strips 52 longitudinally spaced at an inner side between the first circularly arched notches 51 corresponding to the press blocks 317 of the tumbler holder 3, two hooked portions 53 longitudinally spaced at an outer side between the downward end flanges 56, and two second circularly arched notches 55 longitudinally spaced at an inner side between the downward contact strips 52. Two springs 54 are respectively connected between the hooked portions 53 of the locking plates 5 to pull the locking plates 5 together. When the locking plates 5 are installed and abutted against each other, the first circularly arched notches 51 are matched into two circular holes, which receive the ends 61 of the shackle 6, the second circularly arched notches 55 are matched into two circular holes, which receive the upright posts 315 of the tumbler holder 3.

The shackle 6 has a substantially U-shaped profile, two opposite ends 61 for insertion through the shackle slots 11 of the casing 1 into the first circularly arched notches 51 of the locking plates 5 and the retaining holes 45 of the mounting shell 4, and two annular grooves 62 respectively disposed around the periphery of the ends 61 for engagement with the first circularly arched notches 51 of the locking plates 5.

The assembly process of the locking device is easy and outlined hereinafter. The lock cylinder 2 is firstly assembled by mounting the tumblers 21, the steel balls 23, and the springs 22 in the tumbler holder 3, then fastening the cover board 32 to the tumbler holder 3, and then mounting the tumbler holder 3 in the longitudinal chamber 41. Then, the locking plates 5 are mounted on the mounting shell 4 and covered over the tumbler holder 3, and then the mounting shell 4 with the locking plates 5 are inserted into the casing 1 and secured in place by inserting pins 14 into the pin holes 13 of the casing 1 and the pin holes 47 of the mounting shell 4. Then, the ends 61 of the shackle 6 are respectively inserted through the shackle slots 11 of the casing 1 into the first circularly arched notches 51 of the locking plates 5 and the retaining holes 45 of the mounting shell 4, permitting the annular grooves 62 of the ends 61 of the shackle 6 to be forced into engagement with the first circularly arched notches 51 of the locking plates 5. When the locking device is locked, the second hooked portions 212 of the tumblers 21 are respectively forced into engagement with the second vertical slots 44 of the mounting shell 4.

Figure 3:
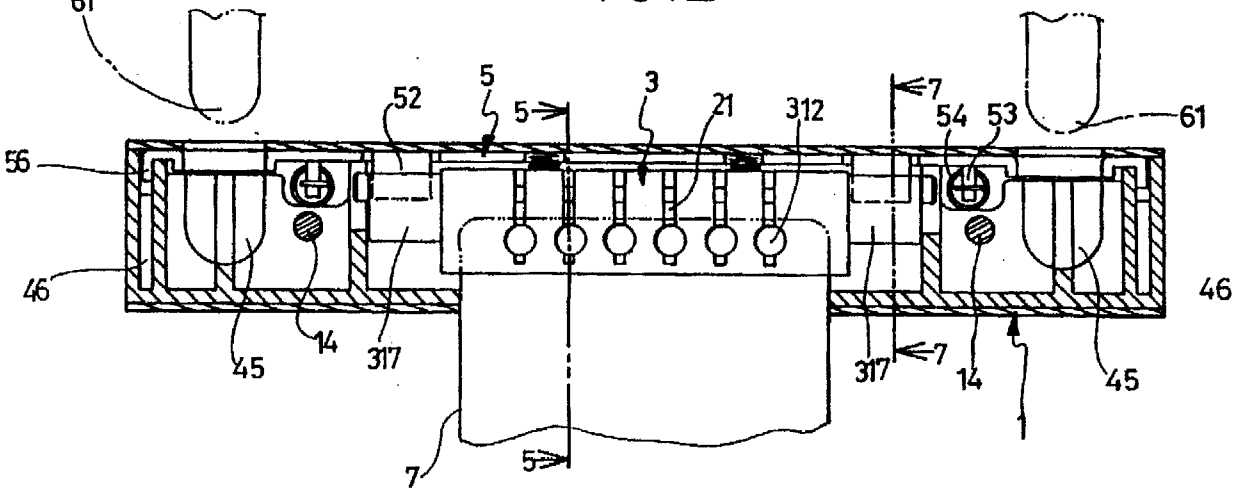
FIG. 3 is similar to FIG. 2 but showing the card inserted, and the shackle unlocked.
Figure 5:
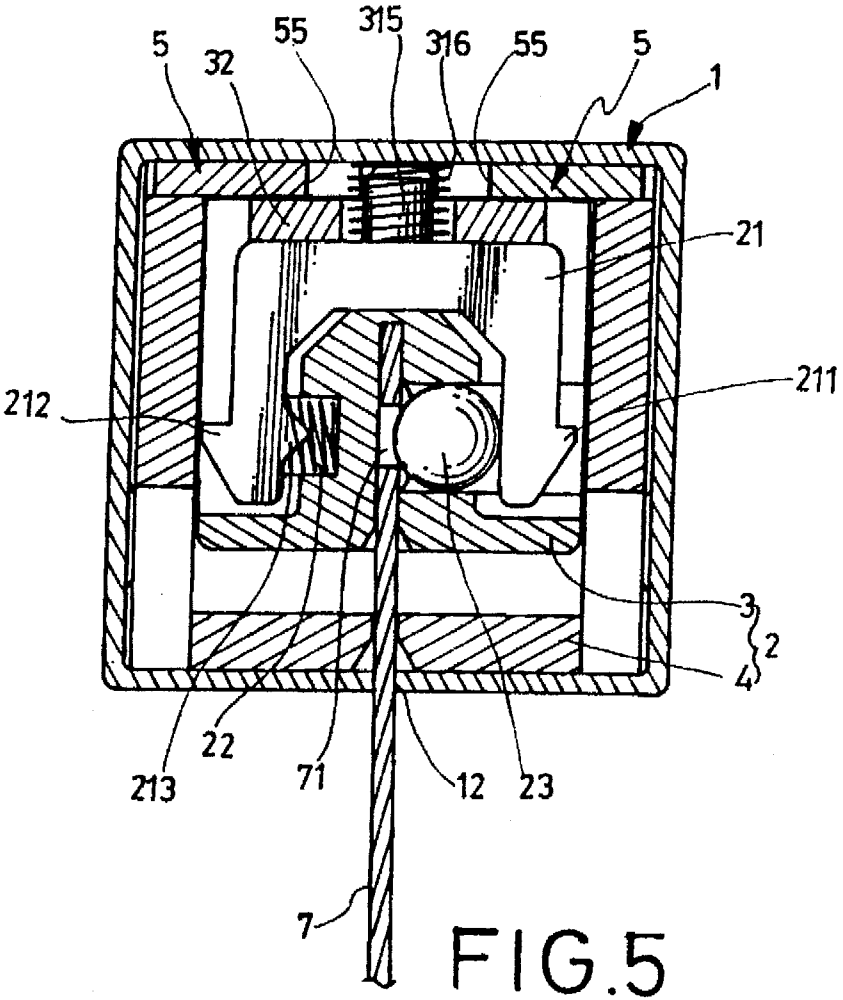
FIG. 5 is a sectional view taken along line B—B of FIG. 3.
Figure 4:
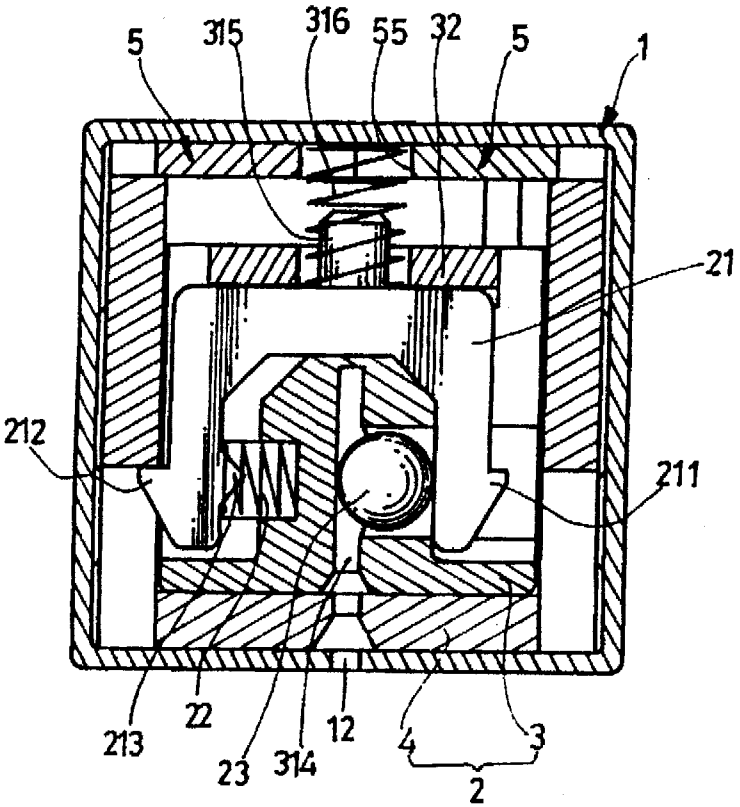
FIG. 4 is a sectional view taken along line A—A of FIG. 2.
Figure 7:
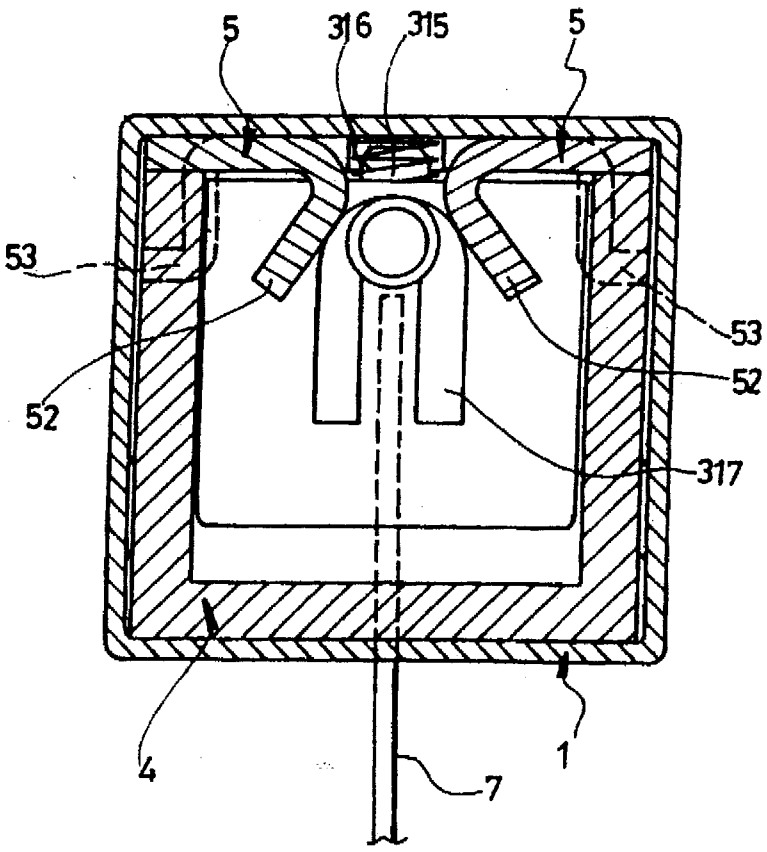
FIG. 7 is a sectional view taken along line D—D of FIG. 3.
Figure 6:
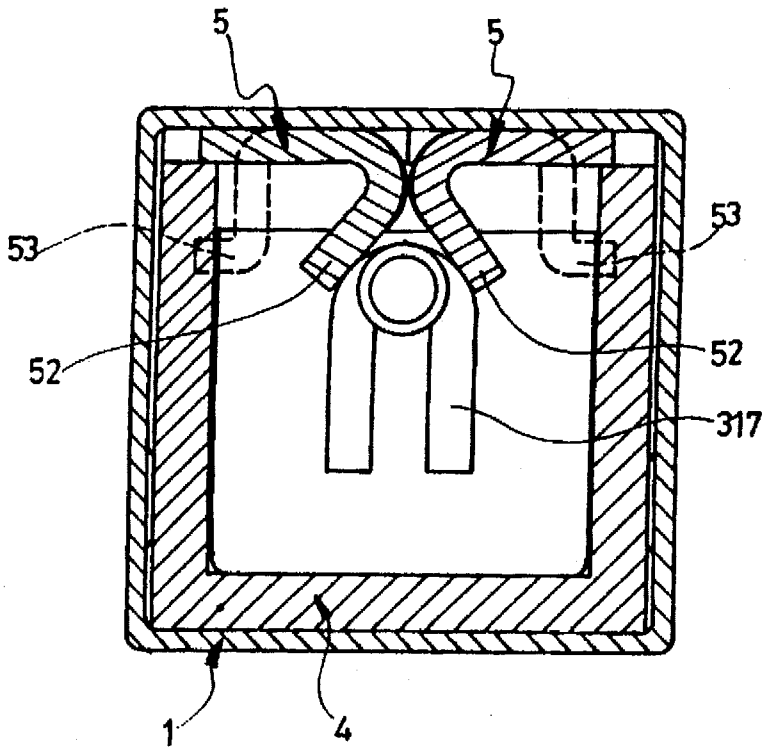
FIG. 6 is a sectional view taken along line C—C of FIG. 2.

When to unlock the locking device, as shown in FIGS. 3, 5, and 7, the card 7 must be used. The card 7 has a set of recessed holes 71 of different diameters. When the card 7 is inserted through the card slot 12 of casing 1 into the bottom slot 42 of the mounting shell 4 and the bottom slot 314 of the tumbler holder 3, the steel balls 23 are respectively forced by the recessed holes 71 of the card 7 to press the tumblers 21, causing the tumblers 21 to displace and to move the respective first hooked portions 211 away from the respective first vertical slots 43 of the mounting shell 4 to the inside of the tumbler holder 3, and then the card 7 is continuously moved upwards to lift the tumbler holder 3, causing the press blocks 317 of the tumbler holders 3 to force the downward contact strips 52 of the locking plates 5 bilaterally outwards, and therefore the locking plates 5 are moved apart to release the ends 61 of the shackle 6, permitting the shackle 6 to be disconnected from the locking plates 5 and the casing 1.

While only one embodiment of the present invention has been shown and described, it will be understood that various modifications and changes could be made thereunto without departing from the spirit and scope of the invention.

What the invention claimed is:

1. A locking device of the type comprising a casing having two shackle slots at a top side and a card slot at a bottom side, a U-shackle having two ends respectively inserted into the shackle slots of said casing, a lock cylinder mounted in said casing, two locking plates mounted in said casing and coupled to said lock cylinder to lock the ends of said U-shackle in said casing, and a card inserted through the card slot of said casing to drive said lock cylinder, causing said lock cylinder to release said locking plates from the ends of said U-shackle for permitting said U-shackle to be disconnected from said casing, wherein: said lock cylinder comprises a tumbler holder, a mounting shell, a set of tumblers, a set of springs, and a set of steel balls, said tumbler holder comprising a rectangular base having a plurality of U-shaped tumbler slots longitudinally spaced at a top side thereof, a plurality of first transverse holes and a plurality of second transverse holes at two opposite lateral sides thereof and respectively extending from said tumbler slots at a bottom side in reversed directions, a bottom slot for the insertion of said card, two upright posts raised from a top side thereof, two press blocks respectively raised from two opposite ends of said rectangular base and moved with said rectangular base to unlock said locking plates, and a cover board connected to said rectangular base by spring means and moved vertically along said upright post to hold said tumblers in said tumbler holder, said steel balls being respectively inserted through said first transverse holes into the inside of said rectangular base, said set of springs being respectively inserted through said second transverse holes into the inside of said rectangular base, each of said tumblers having a substantially U-shaped profile, a first hooked portion and a second hooked portion raised from two opposite ends at an outer side in reversed directions respectively moved relative to said first transverse holes and said second transverse holes of said rectangular base, and a third hooked portion raised from one end at an inner side and respectively connected to said springs, said mounting shell having a rectangular shape, a longitudinal chamber, which receives said tumbler holder, a bottom slot corresponding to the card slot of said casing for the insertion of said card, a plurality of first vertical slots and a plurality of second vertical slots at two opposite sides of said longitudinal chamber corresponding to the first transverse holes and second transverse holes of said rectangular base, two transverse grooves at two opposite ends, two retaining holes spaced between said transverse grooves and said longitudinal chamber for receiving the ends of said U-shackle, and two pairs of pin holes at two opposite sides connected to respective pin holes on said casing by pins; said locking plates are symmetrical and connected in parallel by springs to hold said U-shackle in the locking position, each locking plate comprising two downward end flanges at two opposite ends respectively inserted into the transverse grooves said mounting shell, two first circularly arched notches longitudinally spaced at an inner side between said downward end flanges and adapted to engage the ends of said U-shackle to hold said U-shackle in the locked position, two downward contact strips shackle longitudinally spaced at an inner side between said first circularly arched notches and disposed in contact with the press blocks of said tumbler holder, two hooked portions longitudinally spaced at an inner side between said downward end flanges, and two second circularly arched notches longitudinally spaced at an inner side between said downward contact strips, the first circularly arched notches of said locking plates being matched into two circular holes adapted to engage the ends of said U-shackle, the second circularly arched notches of said locking plates being matched into two circular holes adapted for passing the upright posts of said tumbler holder.

* * * * *